United States Patent [19]

Sharrow et al.

[11] 4,411,040

[45] Oct. 25, 1983

[54] POCKET GOLF BALL WASHER

[76] Inventors: Robert F. Sharrow, 224 Longacre Ave.; Sidney L. Sherman, 5956 Jodie La., both of Erie, Pa. 16509

[21] Appl. No.: 245,523

[22] Filed: Mar. 19, 1981

[51] Int. Cl.[3] ..... A63B 47/04

[52] U.S. Cl. ..... 15/104.94; 15/244 R

[58] Field of Search ..... 15/104.94, 104.92, 361, 15/244 R, 21 A; 206/438, 440; 401/11, 196, 198, 202; 220/306

[56] References Cited

U.S. PATENT DOCUMENTS

| | | | |
|---|---|---|---|
| 293,650 | 2/1884 | Gorman | 15/104.92 |
| 1,382,615 | 9/1921 | Bate . | |
| 1,565,414 | 10/1925 | Byrne | 15/244 R |
| 1,702,172 | 2/1929 | Rennie . | |
| 1,710,816 | 4/1929 | Evans . | |
| 2,438,037 | 3/1948 | Chapman, Jr. | 15/104.92 |
| 2,622,257 | 12/1952 | Lemonds | 15/104.92 |
| 3,098,252 | 7/1963 | Sunquist | 15/104.92 |
| 3,380,095 | 4/1968 | Piper, Jr. . | |
| 3,453,675 | 2/1968 | Barton et al. | 15/104.92 |
| 3,758,000 | 9/1973 | Mack | 220/306 |
| 3,806,983 | 4/1974 | Cunningham et al. . | |
| 4,305,524 | 12/1981 | McLaren et al. | 220/306 |

FOREIGN PATENT DOCUMENTS

| | | | |
|---|---|---|---|
| 8536 | of 1905 | United Kingdom | 15/21 A |
| 404322 | 1/1934 | United Kingdom | 15/21 A |

*Primary Examiner*—James E. Bryant, III
*Assistant Examiner*—Brian J. Bowman
*Attorney, Agent, or Firm*—Charles L. Lovercheck; Wayne L. Lovercheck; Dale R. Lovercheck

[57] ABSTRACT

A pocket golf ball washer is disclosed, made up of a container and a cover. The cover has an outwardly extending rim which snaps over a radially and outwardly directed flange on the container. The container is cup shaped, holding a cylindrical shaped sponge and a cord extends from inside the container through the cover to provide a hidden hinge. A loop for holding a towel is formed by extending back the cord through the container wall; a finger-loop is formed by extending back the cord through the cover.

1 Claim, 4 Drawing Figures

POCKET GOLF BALL WASHER

GENERAL DESCRIPTION

It is not uncommon practice for golfers at the green, to clean the ball by licking the ball surface with their tongue, then rubbing the contaminated surface area against a portion of the golfer's own clothing. A pocket golf ball washer eliminates the danger of getting various fungicides, fertilizers and such golf course grime in the mouth.

This pocket golf ball washer has the appearance of a small flying saucer, about 2 inches in diameter and 1 inch thick. The container and cover are both somewhat cup shaped and are preferably made of white plastic. Inside, is a slightly oversize cylindrical shaped foam sponge which, with a little soap and water, serves to quickly clean a golf ball at the green to allow a clean putt. Ball cleaning takes only a few seconds and the covered container is small enough to fit unobtrusively in a pocket ready to use as the player approaches the ball to putt. The sponge is slightly oversize to prevent it from falling out of the case during handling and ball cleaning. For the advertising specialties market, a flat surface is available on the cover, for personalizing by ink or hot stamping.

REFERENCE TO PRIOR ART

The following patents show various types of golf ball washers wherein two parts are hinged together with a sponge or abrasive material between; however, none of these patents show the basic idea of the cap cover and combination cord and sponge arrangement of applicant's golf ball cleaner.

U.S. Pat. No. 1,382,615 U.S. Pat. No. 1,702,172
U.S. Pat. No. 1,710,816 No. 8,283 British Patent
U.S. Pat. No. 3,380,095 U.S. Pat. No. 3,806,983
U.S. Pat. No. 3,084,287

None of these patents shows applicant's improved ball washer.

OBJECTS OF THE INVENTION

It is an object of the invention to provide an improved golf ball cleaner.

Another object of the invention is to provide a combination golf ball cleaner and towel carrier.

Another object of the invention is to provide an improved golf ball cleaner and sponge combination.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

The sponge can be removed to clean club face.

GENERAL DESCRIPTION OF THE DRAWINGS

DETAILED DESCRIPTION OF THE DRAWINGS

Figure 1:
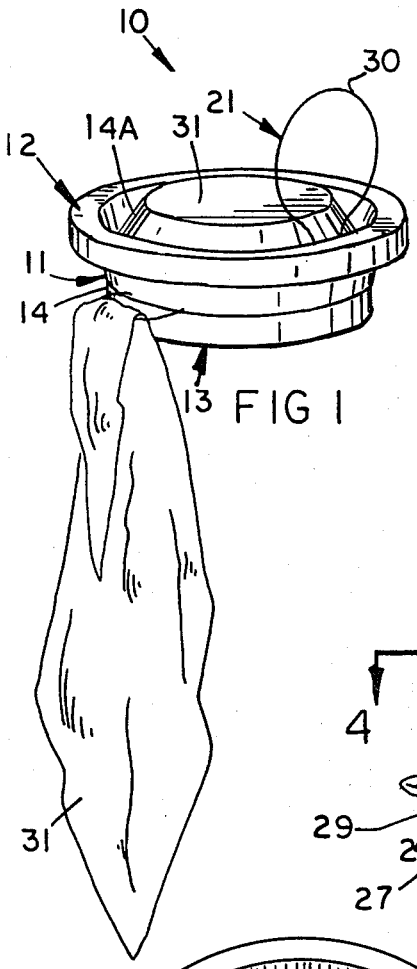
FIG. 1 is a view of the cleaner according to the invention in closed position with a towel supported on the cordloop.
Figure 2:
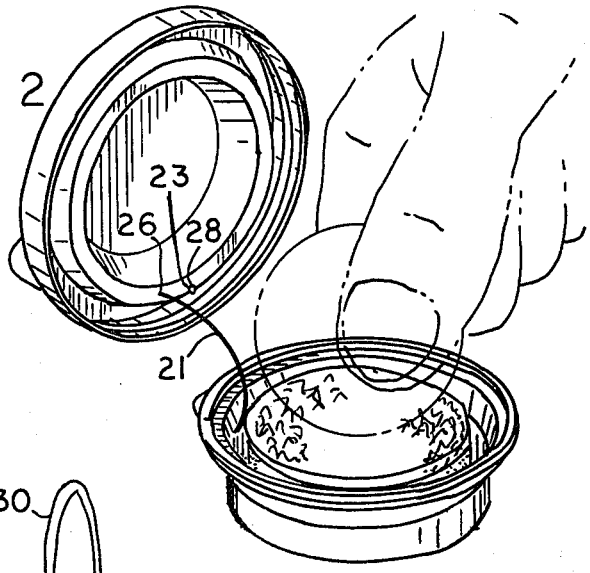
FIG. 2 is a view similar to FIG. 1 showing the golf ball cleaner in an open positon.
Figure 3:
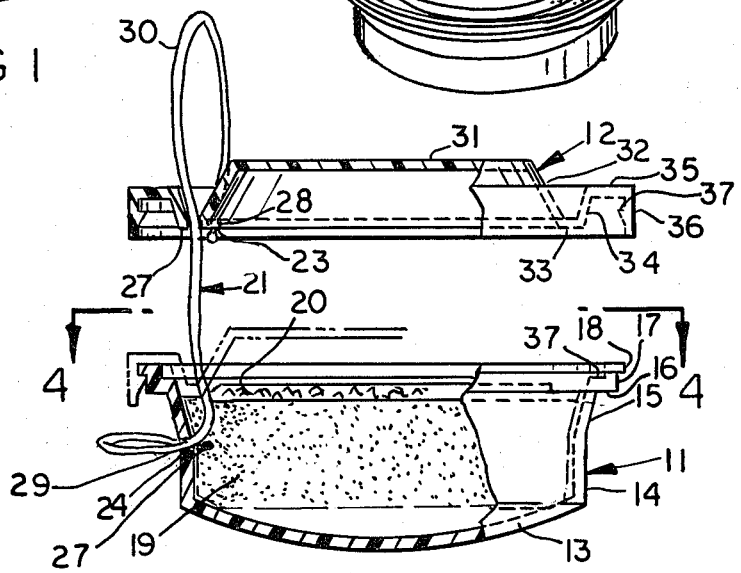
FIG. 3 is a partial cross sectional view of the golf ball cleaner with a cover separated from the cleaner.

Now, with more particular reference to the drawings, I show a golf ball cleaner 10 made up of a container 11, and a cover 12. The container 11 is generally cup shaped and has a convex bottom 13 with a large flat and cylindrical side wall 14 extending up from the bottom 13 and terminating in a side wall part 15. The side wall part 15 extends outwardly and upwardly from the side-wall part 14. The inclined side wall part 15 is integrally attached to a radially outwardly extending shoulder 16. Radially outwardly extending shoulder 16 is integrally attached to upwardly extending cylindrical rim 17, and rim 17 has a radially outwardly extending flange-head 18 integrally fixed to it which cooperates with the cover 12 to provide a double flange-head moisture seal when the cover is in place.

The cover 12 is generally cup shaped and has a side wall 14A and a flat closed top 31. The flat closed top 31 has a donwardly and outwardly extending side wall 32 which terminates in a radially outwardly extending downwardly facing shoulder 33. The cover then extends outwardly and upwardly in wall 34, then radially outwardly at 35, then terminating in cylindrical flange 36 which has an internal flange-head 37 which cooperates with the container flange-head to hold the cover on the container and provide the double seal as stated in paragraph one above.

Figure 4:
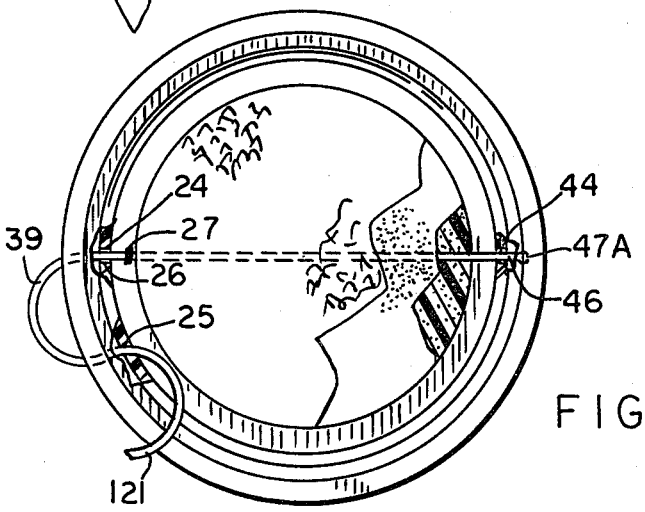
FIG. 4 is a top view of another embodiment of the container with the cover removed.

A slightly oversize cylindrical sponge 19 is normally supported by pressure and friction against the inside wall of the container but also may be held by extending cord 21 diametrically through the sponge 19 and container side wall 14 terminating in enlarged end 47A as shown in FIG. 4. The sponge 19 is adapted to contain water and soap as a cleaning liquid. The preferred sponge material is characteristically somewhat abrasive, as is Polyester foam sponge material having 2#/cu. ft. density, to provide easier removal of caked dirt on a golf ball.

A cord 21, which has three functions, is provided in the ball washer; it acts as a cover retainer, towel holder and handle. The cord 21 has a first enlarged end 27 and a second enlarged end 28 to keep it from pulling back through the container and cover holes.

The container 11 has a first hole 24 and a second hole 25. The cover has a first hole 26 and a second hole 23.

The end 28 of the cord 21 will be put through the first hole 24 with the enlarged end 27 resting against the side wall 14 of the container. The cord 21 will then extend back again through the side wall 15 of the container hole 25, forming a loop 39. The cord 21 continues to the cover 12 inside the container to cover hole 26 and on through to form loop 30 and then back again through the cover hole 23 where the end is enlarged and will rest against the inside of the radially outwardly extending rim 33 of the cover.

The loop 39 may be used to hold a towel 31, and the loop 30 may be used to accept the forefinger of the user to aid in lifting the cover 12 from the container 11. The holes 25 and 26 may be made to a size to provide holding friction against the cord to secure the towel in place.

It will be seen that a golfer can easily carry the cleaner in his pocket according to the invention, and when he desired to clean his ball, he will merely remove the cover 12 from container 11, scrub his ball clean against the foam sponge, wipe the ball against the towel, replace the cover then return the washer to his pocket.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a golf ball cleaner (10) having a container (11), a cover (12), a cylindrical sponge (19), and a cord (21) adapted to be carried in the pocket of a golfer comprising, said container (11) being generally cylindrical and cupshaped and made of relatively rigid material, a generally cup-shaped cover (12), and said cylindrical sponge (19) received in said cup-shaped container, said sponge being flexible and fitting into said container and being adapted to be engaged by said cover, said container comprising, a convex bottom (13) providing a reservoir for fluid below said sponge and extending upwardly therefrom to engage said cover, a cylindrical side wall (14), integrally attached to said bottom and extending upwardly therefrom, and an upwardly and outwardly extending frusto conical shaped side wall (15) integrally attached to said cylindricl side wall and extending upardly and outwardly therefrom providing a space of said sponge to expand into when said cover is closed, a flat annular outwardly extending shoulder (16) attached to said upwardly and outwardly extending side wall (15), an upwardly extending cylindrical rim (17) integrally attached to the outer periphery of said shoulder (16) and an outwardly extending flange head (18) integrally attached to said cylindrical rim (17), said cover (12) being made of relatively rigid material and comprising an annular downwardly and outwardly inclined side wall (32) and a flat top (31) integrally attached to said downwardly and outwardly extending side wall (32) providing additional rigidity to said cover, an outwardly extending rim (33) integrally attached to said downwardly and outwardly inclined side wall (32) and adapted to engage said sponge pushing said sponge downwardly preventing said sponge from interfering with closing of said cover and pushing against said body to prevent said cover from popping off said case, and an upwardly and outwardly extending wall (34) integrally attached to said rim (33), a cylindrical flange (35) integrally attached to said upwardly and outwardly extending wall (34), and a cylindrical flange (36) integrally attached to said cylindrical flange (35) and extending downwardly therefrom, and a flange head (37) integrally attached to the inner periphery of said cylindrical flange (36) and spaced downwardly from said cylindrical flange (35) and adapted to underlie a rib on said upwardly extending rib, said cover (12) being adapted to be received in said container (11) with said outwardly and upwardly extending wall (32) of said cover resting on said upwardly and outwardly extending wall (15) of said container, said cylindrical flange (35) resting on said flange head (18) of said container and cylindrical flange (35) of said cover providing a seal therebetween and said cylindrical flange (35) overlying said flange head of said container and said flange head urging said cover toward said container thereby urging said inclined surface on said cover into engagement with said inclined surface (15) on said container and urging said cylindrical flange (35) into engagement with said sponge, a cord extending through a first opening in said container and through a second opening in said container, then through a third opening in said cover and through a fourth opening in said cover and means on the ends of said cord to prevent said cord from being withdrawn, said cord being substantially longer than the space between said openings whereby substantial loops are provided, a cover loop to receive the finger of an operator for holding said cleaner when said container is closed and a container to receive a towel and said cover may be removed a substantial distance from said container when said cover is opened.

* * * * *